United States Patent [19]

Sugimoto et al.

[11] Patent Number: 4,634,477

[45] Date of Patent: Jan. 6, 1987

[54] WORKABLE HIGH STRENGTH SHAPE MEMORY ALLOY

[75] Inventors: Koichi Sugimoto, Osaka; Kiyoshi Kamei, Hyogo; Yotaro Murakami, Kyoto; Takashi Sugimoto, Osaka; Takashi Nishimura, Kobe; Takahiro Takashima, Hyogo, all of Japan

[73] Assignee: Kabushiki Kaisha Kobe Seiko Sho, Kobe, Japan

[21] Appl. No.: 776,807

[22] Filed: Sep. 17, 1985

[51] Int. Cl.[4] ..... C22C 9/01

[52] U.S. Cl. ..... 148/402; 420/486

[58] Field of Search ..... 148/402; 420/486

[56] References Cited

FOREIGN PATENT DOCUMENTS

| | | | |
|---|---|---|---|
| 35069 | 3/1980 | European Pat. Off. | 148/402 |
| 58-34154 | 2/1983 | Japan | 420/486 |
| 58-167737 | 4/1983 | Japan | 420/486 |
| 60-77947 | 5/1985 | Japan | 148/402 |
| 206097 | 12/1967 | U.S.S.R. | 420/486 |
| 579332 | 11/1977 | U.S.S.R. | 420/486 |

*Primary Examiner*—L. Dewayne Rutledge
*Assistant Examiner*—Robert L. McDowell
*Attorney, Agent, or Firm*—Oblon, Fisher, Spivak, McClelland & Maier

[57] ABSTRACT

A workable high strength shape memory alloys comprising:
Al: 11.5–13.5%,
Ni: 2–6%,
Mn: 1–5%,
Ti: 0.1–5%, each on the weight basis, and the balance of Cu and inevitable impurities.

In the modified alloy composition, the workability can be improved without increasing the martensitic transformation temperature.

1 Claim, 1 Drawing Figure

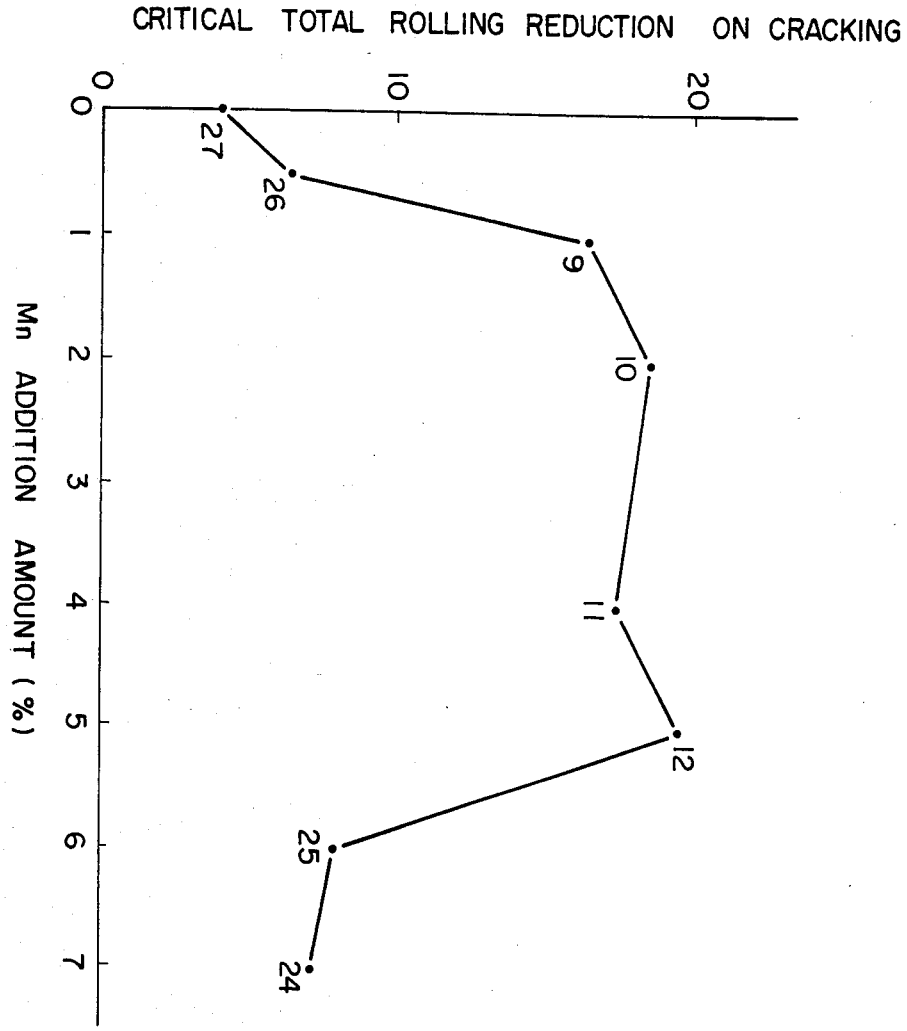
CRITICAL TOTAL ROLLING REDUCTION ON CRACKING
20
10
0
27
26
9
10
11
12
25
24
0
1
2
3
4
5
6
7
Mn ADDITION AMOUNT (%)

WORKABLE HIGH STRENGTH SHAPE MEMORY ALLOY

BACKGROUND OF THE INVENTION (1) Field of the Invention

This invention concerns Cu-Al-Ni shape memory alloys and, more specifioally, it relates to the improvement in the workability of the shape memory alloys of the above-mentioned type by the modification to the alloy composition.

(2) Description of the Prior Art

In the field of the shape memory alloys, there exist problems for the development of novel alloys and for finding new application uses thereof, which stimulate to each other such that possible application uses are sought for newly developed alloy and, vice versa, new alloys are demanded for expected uses. Among the shape memory alloys having thus been developed, AuCd, Cu-Zn-Al, Cu-Al-Ni and the like have been noted as being comparable with the Ti-Ni type alloys. Particularly, the latter two Cu type alloys are generally considered prominent in view of their low cost. When comparing the two Cu type alloys with each other, Cu-Al-Ni alloy is superior both in the shape memory performance and heat stability (heat resistivity) and attracts general attention. However, the defect in the Cu-Al-Ni alloy of low cold workability somewhat hinders the trend for the exploitation of its application uses. The present inventors, considering such a situation, have already found that the workability of the Cu-Al-Ni alloy can be improved by blending Ti therewith to render the crystal grain finder and disclosed such a finding in Japanese Patent Laid-Open No. 167737/1983.

While the effect of improving the workability disclosed in our invention is due to the refinement of the grain by the blend of Ti and provides a usefulness in the practical point of view, a considerable room seems to be left for the improvement in view of the metal structure. That is, aside from the property of the $\beta$ phase itself in the Cu-Al type alloy, the difficulty upon fabrication of the Cu type alloy is attributable, to the fact that the intermetallic compound $\gamma 2$ phase tends to be deposited as the secondary phase because the Al content lies on the side of the hyper-eutectoid alloy region in the Cu-Al-Ni alloy.

Based on the above-mentioned considerations, we have reached an idea that it is important, for the improvement in the workability of the Cu-Al-Ni alloy, to restrict the hardness by suppressing the deposition of the intermetallic compound 2 phase as low as possible and rendering the grain size as fine as possible. This invention has been accomplished on the basis of such concept, and by realizing the concept along with the modification in the alloy composition.

SUMMARY OF THE INVENTION

This invention provides workable high strength shape memory alloys comprising:

Al: 11.5–13.5%,

Ni: 2–6%,

Mn: 1–5%,

Ti: 0.1–5%, each on the weight basis, and the balance of Cu and inevitable impurities.

As described above, the Al content in the Cu-Al-Ni alloy lies in the hyper-eutectoid region (the eutectoid is about 12% or less as described in "Shape Memory Alloy", edited by Hiroyasu Funakubo, published from Sangyo Tosho Shuppan, and the content is defined, for example, as from 13 to 14.5% in our Japanese Patent Laid-Open No. 167737/1983). Accordingly, the reduction in the Al content seems to be a primary means along with the concept of suppressing the deposition of the $\gamma 2$ phase. However, since the reduction in the Al content tends to increase the martensitic transformation temperature and this means the increase in the operation temperature of the shape memory alloy, there exists an inevitable limit to the reduction of the Al content. Then, we have made various studies looking for the capability of suppressing the deposition of the $\gamma 2$ phase and, if possible, also lowering the martensitic transformation temperature (Ms point) by some or other additive elements and, as the result, have expectedly found that Mn is excellent as such a candidate.

The ground for specifying the range of the respective alloy elements in this invention will now be explained:

Al:11.5–13.5%.

In a sense of reducing the deposition of the $\gamma 2$ phase, lesser Al content is better. Although the reduction in the Al content seems to be impossible because of the attendant increase in the Ms point, this negative effect can be offset by the addition of Mn that tends to lower the Ms point. Considering that the effect of reducing the Ms point attained by the addition of Mn is 45° C. per 1% Mn and that the upper limit for Mn is 5% as described later, the Al content is specified as from 11.5 to 13.5% based on the requirement that the operation temperature of the shape memory alloy should be kept within a moderate practical range. That is, if the Al content is less than 11.5%, the Ms point increases to as high as 300° C. even if Mn is added. While on the other hand, if the Al content exceeds 13.5% the deposition of the $\gamma 2$ phase is increased failing to attain the intended purpose of improving the workability.

Mn: 1–5%

As described above, while Mn can suppress the deposition of the $\gamma 2$ phase and also reduce the Ms point, no substantial effect can be attained with the Mn content of less than 1%. Since Mn has advantageous effects of moderating the bound imposed on the reduction in the Al content and of positively improving the workability and reducing the Ms point, there is no upper limit so far as these effects are concerned. However, if the Mn content exceeds 5%, the workability is worsened because of the work hardening. Therefore, upper limit for the Mn content is specified as up to 5%. Addition of Mn provides a significant effect for the cold workability. The results are shown in Table 3 and FIG. 1. From 1 to 5% addition is excellent for the workability.

Ni: 2–6%

Ni has to be blended by 2% or more for the stabilization of the structure. However, excess blending results in the hardening in the martensite phase to degrade the workability. Accordingly, its upper limit is specified as up to 6%.

Ti: 0.1–5%

Ti is an element useful for rendering the crystal grain finer. Specifically, the granular deposition product X phase (TiNi compound or (Cu, Ni)Ti compound) resulted from the addition of Ti provides an effect of suppression of grain growth. However, no substantial effect can be obtained with the Ti content less than 0.1%. However, since there is a problem that Ti addition in excess of 5% brings about much difficulty the reversible transformation at the Ms point, its upper limit is specified as up to 5%.

The alloy according to this invention also comprises Cu and inevitable impurities as the balance and such impurities include, for example, Fe and Pb.

DESCRIPTION OF PREFERRED EMBODIMENT AND ACCOMPANYING DRAWING

These and other objects as well as advantageous features of this invention will be made clearer by the following descriptions of examples while referring to the accompanying drawing, wherein the figure is a graph showing the relationship between the Mn addition amount (%) on the abscissa and the critical total rolling reduction (%) causing crackings on the ordinate.

EXAMPLE 1

Alloys having compositions as shown in Table 1 were prepared by using electrolytic cathode copper at 99.9% degree, Al at 99.99% degree, and electrolytic Ni and Mn (melted in a high frequency melting furnace). They were cast in a graphite casting mold to prepare round bars sized 15 mm $\phi$.

TABLE 1

| | No. | Al | Ni | Mn | Ti | Cu and impurity |
|---|---|---|---|---|---|---|
| Alloy of this invention | 1 | 12.07 | 5.0 | 3.0 | 1.0 | balance |
| | 2 | 11.74 | 6.0 | 3.0 | 1.0 | " |
| | 3 | 12.46 | 5.0 | 3.0 | 0.1 | " |
| | 4 | 12.46 | 5.0 | 3.0 | 0.5 | " |
| | 5 | 12.46 | 5.0 | 3.0 | 1.0 | " |
| | 6 | 12.12 | 2.0 | 3.0 | 1.0 | " |
| | 7 | 12.12 | 4.0 | 3.0 | 1.0 | " |
| | 8 | 12.12 | 6.0 | 3.0 | 1.0 | " |
| | 9 | 12.12 | 5.0 | 1.0 | 1.0 | " |
| | 10 | 12.12 | 5.0 | 2.0 | 1.0 | " |
| | 11 | 12.12 | 5.0 | 4.0 | 1.0 | " |
| | 12 | 12.12 | 5.0 | 5.0 | 1.0 | " |
| | 13 | 12.12 | 5.0 | 3.0 | 2.0 | " |
| | 14 | 12.12 | 5.0 | 3.0 | 4.0 | " |
| Comparative alloy | 15 | 13.07 | 5.0 | — | — | " |
| | 16 | 12.74 | 6.0 | — | — | " |
| | 17 | 12.40 | 7.0 | — | — | " |
| | 18 | 13.46 | 5.0 | — | — | " |
| | 19 | 13.12 | 6.0 | — | — | " |
| | 20 | 12.78 | 7.0 | — | — | " |
| | 21 | 12.74 | 6.0 | — | 1.0 | " |
| | 22 | 13.12 | 6.0 | — | 1.0 | " |
| | 23 | 12.12 | 5.0 | 7.0 | 0.5 | " |
| | 24 | 12.12 | 5.0 | 7.0 | 1.0 | " |
| | 25 | 12.12 | 5.0 | 6.0 | 1.0 | " |
| | 26 | 12.12 | 5.0 | — | 1.0 | " |
| | 27 | 12.12 | 5.0 | 0.5 | 1.0 | " |

A portion of an ingot was laterally cut and polished. When the cast microstructure was investigated, the alloys according to this invention of No. 1 through No. 14 and comparative alloys containing Ti of No. 21 through 27 show fine regular structure, while comparative alloys not containing Ti of No. 15 through No. 20 exhibit coarsely grown granular structures, by which effectiveness of Ti was confirmed.

EXAMPLE 2

Test pieces were cut out from the round bar alloy obtained in Example 1, heated in a muffle furnace at 900° C., forged and then rolled to obtain sheets of 3 mm thickness. Then, after maintaining them at 800° C. for 10 minutes further, they were classified into those cooled spontaneously in atmosphere and quenched in water at 0° C. and the hardness was measured by the Vickers hardness tester. The results are as shown in Table 2.

TABLE 2

| | No. | Spontaneous quenching | Water quenching |
|---|---|---|---|
| Alloy of this invention | 1 | 260 | 210 |
| | 2 | 263 | 220 |
| | 3 | 270 | 230 |
| | 4 | 265 | 227 |
| | 5 | 250 | 225 |
| | 6 | 220 | 198 |
| | 7 | 235 | 203 |
| | 8 | 265 | 222 |
| | 9 | 270 | 225 |
| | 10 | 265 | 225 |
| | 11 | 240 | 220 |
| | 12 | 236 | 220 |
| | 13 | 245 | 210 |
| | 14 | 240 | 205 |
| Comparative alloy | 15 | 300 | 255 |
| | 16 | 310 | 270 |
| | 17 | 382 | 290 |
| | 18 | 320 | 258 |
| | 19 | 342 | 260 |
| | 20 | 373 | 270 |
| | 21 | 295 | 240 |
| | 22 | 320 | 245 |
| | 23 | 290 | 220 |
| | 24 | 305 | 220 |
| | 25 | 300 | 220 |
| | 26 | 290 | 245 |
| | 27 | 285 | 235 |

As can be seen from Table 2, the hardness is reduced in the alloy according to this invention. A particularly remarkable effect was recognized by the addition of Mn, as well as by the reduction in the A1 content. Thus, improving effect for the workability by the reduction in the hardness can be provided. In the comparative alloys, considerable increase in the hardness was recognized and, particularly, the increase in the hardness was remarkable in No. 17 and No. 20, where large amount of Ni was added.

EXAMPLE 3

Rectangular test pieces sized 30 mm(l)×10 mm(w)×2.5 mm(t) were prepared from the water quenched test pieces obtained in Example 2 and examined for the cold workability. That is, the test pieces were rolled repeatedly, at about 0.8% reduction for each pass by a cold rolling mill and examined the critical total rolling reduction at which crackings were caused.

TABLE 3

| | Alloy No. | Critical total rolling reduction upon crack generation |
|---|---|---|
| Alloy of this invention | 1 | 19.3 |
| | 2 | 15.2 |
| | 3 | 13.2 |
| | 4 | 13.8 |
| | 5 | 16.5 |
| | 6 | 20.5 |
| | 7 | 19.8 |
| | 8 | 17.0 |
| | 9 | 16.5 |
| | 10 | 18.6 |
| | 11 | 17.5 |
| | 12 | 19.6 |
| | 13 | 16.0 |
| | 14 | 18.4 |
| Comparative alloy | 15 | 2.0 |
| | 16 | 1.2 |
| | 17 | 0 |
| | 18 | 1.8 |
| | 19 | 1.5 |
| | 20 | 0 |

TABLE 3-continued

| Alloy No. | Critical total rolling reduction upon crack generation |
|---|---|
| 21 | 8.2 |
| 22 | 6.5 |
| 23 | 2.4 |
| 24 | 7.2 |
| 25 | 8.0 |
| 26 | 4.0 |
| 27 | 6.4 |

As can be seen from Table 3, although the comparative alloys were cracked at a slight total rolling reduction, the critical total rolling reduction at which the crackings were caused was remarkably increased in the alloys accordng to this invention.

Since the alloy composition as described above is used in this invention, deposition of the $\gamma 2$ phase can be retained while preventing the increase in the Ms point, by which the reduction in the hardness is intended. Accordingly, improvement in the workability can be attained while maintaining the operation temperature of the shape memory alloy within a range as causing no practical disadvantages.

What is claimed is:

1. In a workable high strength shape memory alloy, consisting essentially of aluminum in amounts of 11.5–13.5%, nickel in amounts of 2–6%, titanium in amounts of 0.1–5%, and the balance copper, the improvement comprising the addition of Mn in amounts of 1–5%, to improve workability, all on a weight basis.

* * * * *